US005460500A

United States Patent [19]

Geus et al.

[11] Patent Number: 5,460,500

[45] Date of Patent: Oct. 24, 1995

[54] APPARATUS FOR PRODUCING A NONWOVEN SPUN-FILAMENT WEB OF AERODYNAMICALLY STRETCHED FILAMENT OF A PLASTIC

[75] Inventors: Hans G. Geus, Niederkassel; Hermann Balk, Troisdorf; Bernd Kunze, Hennef, all of Germany

[73] Assignee: Reifenhauser GmbH & Co. Maschinenfabrik, Troisdorf, Germany

[21] Appl. No.: 227,977

[22] Filed: Apr. 15, 1994

[30] Foreign Application Priority Data

Apr. 16, 1993 [DE] Germany ..... 43 12 419.4

[51] Int. Cl.[6] ..... B29C 47/90

[52] U.S. Cl. ..... 425/66; 264/40.3; 264/210.8; 264/211.15; 264/518; 425/72.2; 425/DIG. 17

[58] Field of Search ..... 264/176.1, 210.8, 264/518, 555, 40.3, 211.12, 211.14, 211.15; 425/66, 72.2, DIG. 17

[56] References Cited

U.S. PATENT DOCUMENTS

| | | | |
|---|---|---|---|
| 3,929,542 | 12/1975 | Gehrig et al. | 156/167 |
| 4,340,563 | 7/1982 | Appel et al. | 264/518 |
| 4,405,297 | 9/1983 | Appel . | |
| 4,692,106 | 9/1987 | Grabowski | 425/66 |
| 4,812,112 | 3/1989 | Balk | 425/66 |
| 4,813,864 | 3/1989 | Balk | 425/66 |
| 4,820,142 | 4/1989 | Balk | 425/66 |
| 4,820,459 | 4/1989 | Reifenhäuser | 264/40.3 |
| 4,838,774 | 6/1989 | Balk | 425/66 |
| 4,851,179 | 7/1989 | Reifenhäuser | 264/555 |
| 5,028,375 | 7/1991 | Reifenhäuser | 264/518 |
| 5,032,329 | 7/1991 | Reifenhäuser | 264/40.5 |

FOREIGN PATENT DOCUMENTS

| | | |
|---|---|---|
| 0224435 | 6/1987 | European Pat. Off. . |
| 40 14 989 | 11/1991 | Germany . |
| 47-24168 | 4/1972 | Japan . |

*Primary Examiner*—Jay H. Woo
*Assistant Examiner*—Joseph Leyson
*Attorney, Agent, or Firm*—Herbert Dubno

[57] ABSTRACT

A spun-filament nonwoven web is deposited on a sieve belt from a spinning head producing a curtain of thermoplastic filaments which traverse a cooling chamber by drawing the filaments in a drawing nozzle separate from the cooling chamber and passing the filaments through a delivery unit and in the form of a jet pump, air flow through which is controlled at least in part by a suction blower below that sieve belt.

2 Claims, 4 Drawing Sheets

APPARATUS FOR PRODUCING A NONWOVEN SPUN-FILAMENT WEB OF AERODYNAMICALLY STRETCHED FILAMENT OF A PLASTIC

FIELD OF THE INVENTION

Our present invention relates to an apparatus for producing a nonwoven spun-filament web of aerodynamically stretched filaments of a thermoplastic synthetic resin. More particularly the invention relates to an apparatus which is capable of producing such nonwoven webs at a higher rate, with greater reliability and more uniform properties than has hitherto been the case.

BACKGROUND OF THE INVENTION

An apparatus for producing a spun fleece or nonwoven web of stretched filaments of thermoplastic synthetic resin generally comprises a spinning head from which a curtain of the filaments emerges, a cooling chamber below the spinning head within which the filaments are quenched, a stretching nozzle below the cooling chamber and a sieve or perforated belt upon which the filaments are deposited to form the nonwoven web. A suction source can be located below the belt for drawing air through the belt and assisting in the depositing of the nonwoven web.

Apparatus of this type and for these purposes is available in various configurations. They must, however, generally satisfy two basic requirements, namely high output in terms of the spun fleece web which is produced per unit time and the maintenance of certain quality parameters of the web within narrow tolerances.

In the apparatus described in U.S. Pat. No. 4,405,297, the stretching nozzle is a gap with a comparatively large gap width, defined by a gap-forming wall which extends substantially up to the spinning head, and another wall which is inclined toward the first wall to form a wedge-shaped cooling chamber therewith and which extends to a point at which process air can be admitted.

A special fleece deposition unit is not here provided and the stretching nozzle in the form of the gap simultaneously constitutes the fleece-deposition device.

As a consequence, a relatively large gap width is required and the gap width must be adjustable up to say 45 mm in practice.

To maintain a predetermined stable operating state with the desired output, a certain process air flow rate is required. When the output is to be increased, the process air flow rate must be increased and in practice it is found that the ability to change the process air flow rate is highly limited if quality parameters of the nonwoven web are to be maintained.

In another apparatus (see DE 40 14 989 A1), the cooling chamber has a decreasing cross section in the direction of travel of the filaments and a cross section which is rectangular in horizontal section, the cooling chamber feeding into a venturi-like constriction whose narrowest part is followed by a diffuser outlet. Here as well a special fleece-deposition unit is not provided.

The venturi constriction serves as a stretching nozzle and is shaped aerodynamically in a corresponding manner. In the transition region between the cooling chamber and the stretching nozzle a free air inlet gap is provided. An effect upon the deposition of the fleece on the sieve belt was obtained by adjustable flaps in the flow passages of the apparatus. If one attempts to increase the output starting from a stable operating state, the process air flow rate must also increase here. This gives rise to problems when deterioration of the quality parameter of the spun-fleece web is to be avoided.

OBJECTS OF THE INVENTION

It is, therefore, the principal object of the present invention to provide an apparatus of the aforedescribed construction and for the purposes described so that a significant increase in output is possible without detriment to the quality parameter of the nonwoven web.

It is also an object of this invention to provide an apparatus for the purposes described which is free from drawbacks of earlier systems.

SUMMARY OF THE INVENTION

These objects and others which will become apparent hereinafter are attained, in accordance with the invention, in an apparatus which comprises:

- a filament spinning head provided with a multiplicity of spinning orifices discharging respective strands of thermoplastic synthetic resin in at least one row to form a descending curtain of the strands;
- a vertically extending cooling chamber below the filament spinning head receiving the curtain for quenching same and having a rectangular cross section in horizontal planes decreasing downwardly to a smallest cross section $K_q$ at a lower end of the cooling chamber;
- a stretching nozzle adjacent the lower end of the cooling chamber and extending downwardly therefrom, the stretching nozzle having opposite walls flanking the curtain and between which the strands are aerodynamically stretched by entrainment with air through the stretching nozzle, the stretching nozzle having a rectangular flow cross section $D_q$ in a horizontal plane which is smaller by a factor of 0.9 to 0.01 than the smallest cross section $K_q$ at the lower end of the cooling chamber so that $D_q$ is substantially equal to 0.9 $K_q$ to 0.01 $K_q$;
- a setback formed on a lower end of at least one of the walls;
- a filament delivery unit below the stretching nozzle and receiving the strands therefrom, the filament delivery nozzle including a vertically disposed jet pump having an inlet at an upper end, a venturi constriction below the inlet and a diffusor outlet below and connected with the constriction, the jet pump having a flow passage section between the inlet and the outlet which is rectangular in horizontal cross section, the inlet being open to ambient atmosphere whereby ambient air is drawn through the unit;
- a continuously movable sieve belt below the filament delivery unit receiving the filaments therefrom in a nonwoven web, the nonwoven web being carried away from the filament delivery unit on the belt; and
- a controllable flow rate suction source below the belt and the filament delivery unit and communicating with the filament delivery unit through the belt for regulating air flow through the jet pump.

The spinning head can have a multiplicity of spinning orifices arranged in at least one and preferably a plurality of rows so that the curtain passes from a broad selection of orifices into at least a single row of the strands of thermoplastic synthetic resin.

The suction source or suction blower below the sieve belt serves to regulate at least in part the quantity of air which is drawn through the filament delivery unit so that this air quantity is controllable or regulatable by the suction blower.

The invention is based upon our finding that, to increase the output for an apparatus of the aforedescribed type, the stretching function on the one hand and the filament delivery on the other must be separated and must utilize separate apparatus components.

It must be emphasized that all of the features set forth must be present, including the stretching nozzle separate from the cooling chamber and the filament delivery unit and the setback or setbacks formed on the lower end of one or both of the walls defining the stretching nozzle. Surprisingly, with this combination of features, the acceleration resulting from the process air drawn through the stretching nozzle allows a filament speed of 2000 m/min or more to be achieved. The limited gap width of the stretching nozzle reduces the volume of process air which must traverse the stretching nozzle while nevertheless allowing high velocities to be achieved.

Detrimental contacts of the filaments with the nozzle-forming walls of the stretching nozzle do not occur because of the setbacks at the outlet side of the stretching nozzle and thus the reduction in quality of the nonwoven web which might result from such contact is avoided.

Since the filament-delivery unit is in the form of a jet pump and the suction flow is generated by a suction blower beneath the sieve belt, nonwoven spun fleece webs can be produced which satisfy all of the desirable quality characteristics.

The stretching nozzle can have a nozzle cross section or thickness which is not permitted to vary by reason of fluctuations in the position of the nozzle-forming walls as may result from the passage of process air therethrough. To this end, the stretching nozzle can have a box-like configuration with nozzle walls composed of sheet metal and the deformations of the nozzle walls by the aerostatic pressure in the gap being balanced by a controllable or regulatable internal pressure of the box-like structure.

According to a feature of the invention, the filament delivery unit has adjustable side walls so that the air flow drawn through the jet pump can be additionally influenced. The jet pump, of course, can extend the full width of the curtain of filaments and be operated by the air stream emerging from the stretching nozzle as has also been influenced or effected by the suction blower below the perforated belt.

As has previously been indicated, the apparatus of the invention allows high throughputs to be achieved together with high levels of the quality parameter of the nonwoven web. It is of special significance that the filament speed can be up to or in excess of 2000 m/min.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
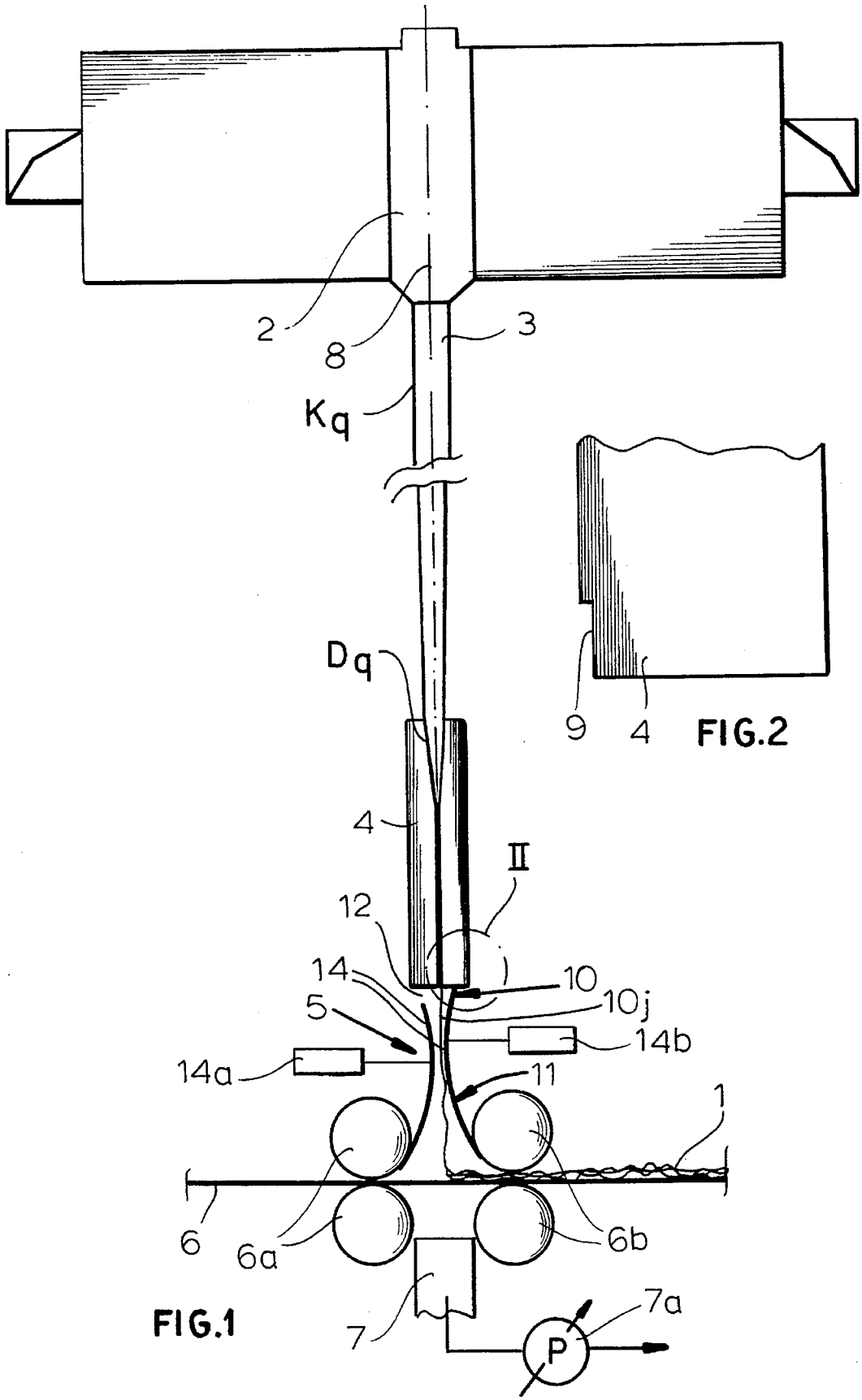
FIG. 1 is a diagram of an apparatus in accordance with the present invention for producing a spun-filament nonwoven web.
FIG. 2 is a detail of the region II of FIG. 1 greatly enlarged in scale.

The apparatus shown in the drawing for the production of a spun-filament nonwoven web 1 from aerodynamically stretched filaments or strands of thermoplastic synthetic resin comprises basically a spinning head 2, a cooling chamber 3 below the spinning head 2, a stretching nozzle 4 located below the cooling chamber 3, a filament-delivery unit 5 located below the stretching nozzle 4, a perforated sieve belt 6 which may be an endless belt, collecting the web 1 below the delivery unit 5, and a suction source or suction blower 7.

Figure 5:
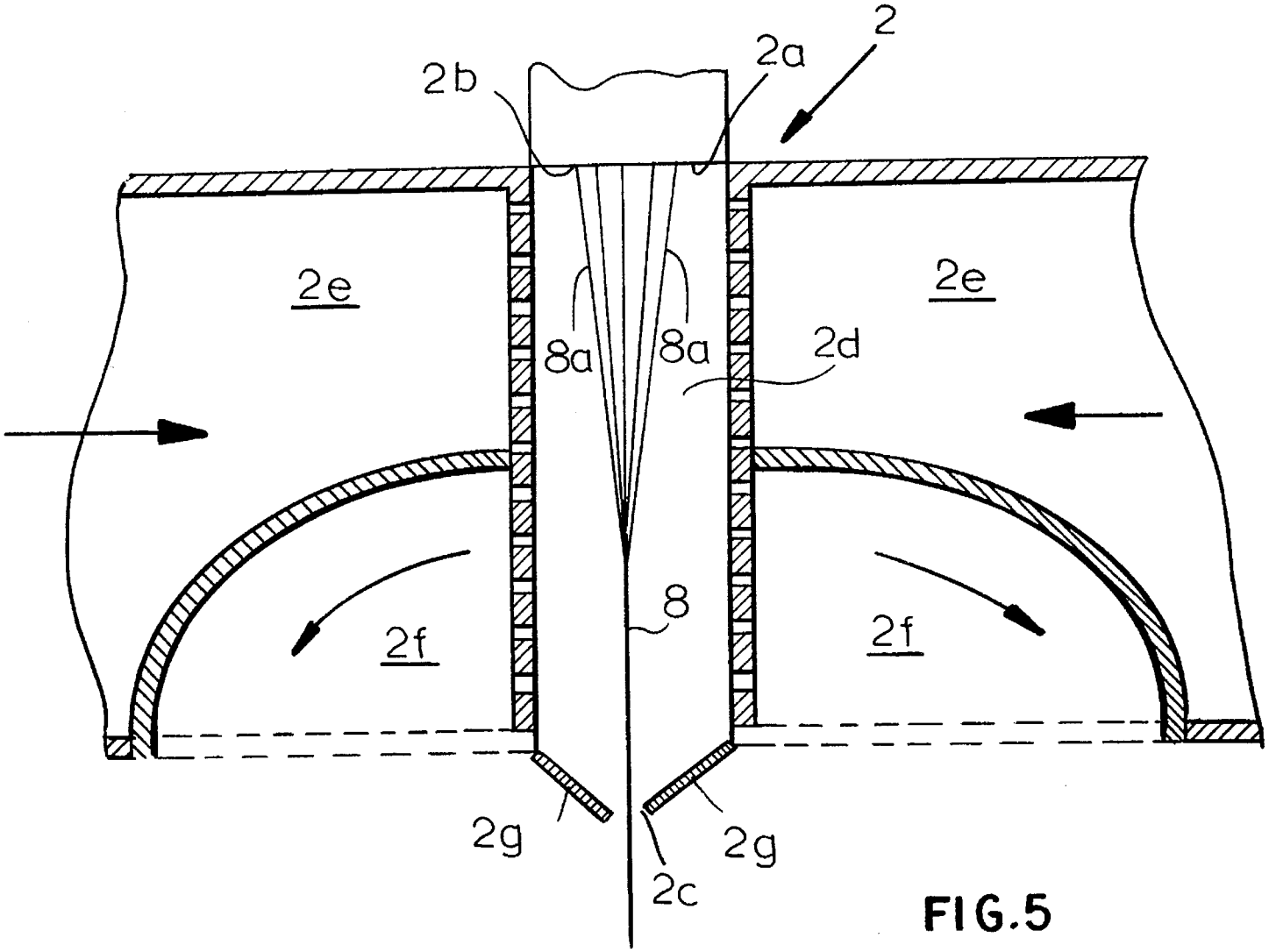
FIG. 5 is a diagrammatic sectional view of a portion of the blowing head.

As can be seen from FIG. 5, the spinning head 2 can comprise a nozzle or orifice plate 2*a*, also referred to as a spinneret, with orifices 2*b* from which liquid strands 8*a* of thermoplastic synthetic resin issue in a curtain of filaments 8 which can be a single row of filaments where the curtain issues at 2*c* from the head 2 and is wider at its upper end. Initial quenching may be carried out in a compartment 2*c* to which quenching air is fed from ducts 2*e*. A portion of the air can be discharged through ducts 2*f* while the balance accompanies the curtain of filaments 8 into the cooling chamber 3. At the outlet side of the chamber 2*d*, swingable flaps 2*g* may be provided.

The cooling chamber 3 has a rectangular horizontal cross section which decreases in the flow direction, namely, downwardly. This flow cross section is represented at $k_q$ and as has been indicated previously, the smallest cross section $K_q$ is greater than the smallest cross section $D_q$ of the stretching nozzle 4 below the cooling chamber 3 and connected therewith.

Figure 6:
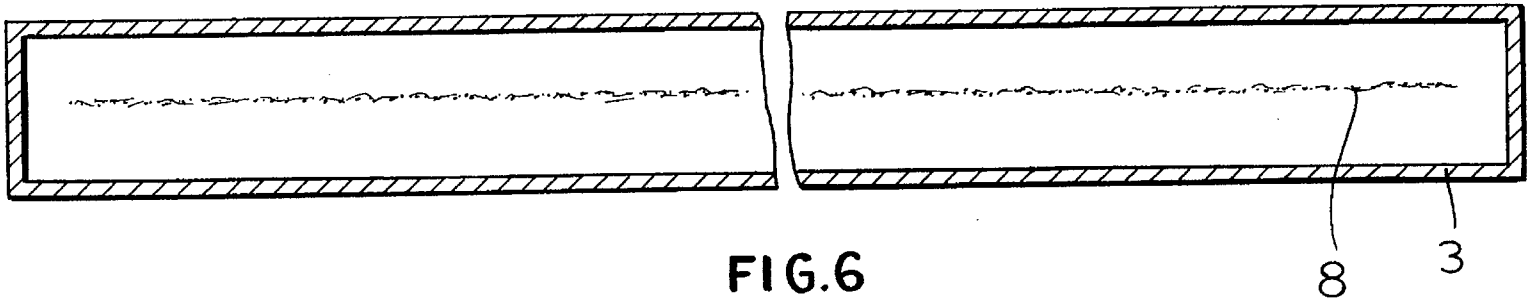
FIG. 6 is a sectional view through a cooling chamber showing the rectangular configuration thereof.

FIG. 6 shows the cross section of the cooling chamber 3 which, of course, is geometrically similar to the cross section of the stretching nozzle 4.

From FIG. 2 it will be apparent that at the discharge end of the stretching nozzle 4, the walls 13 which define it are provided with setbacks as shown at 9. The depth of the setback is less than the gap width defined by the nozzle 4.

Figure 7:
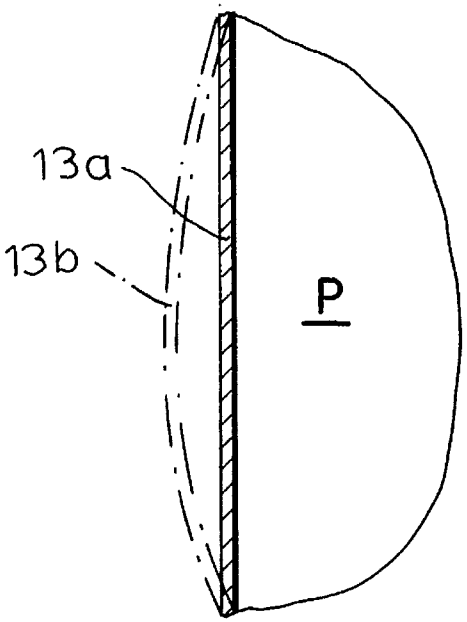
FIG. 7 is a detail view illustrating one of the principles of the invention.

Furthermore, as will be apparent from FIG. 7, a wall 13*a* defining the stretching nozzle gap and which might bulge or fluctuate by reason of aerodynamic forces in the gap and as shown in dot-dash lines in 13*b* in FIG. 7, can be prevented from so shifting by control of the pressure P in the boxlike structure behind each wall 13*a*.

Figure 4:
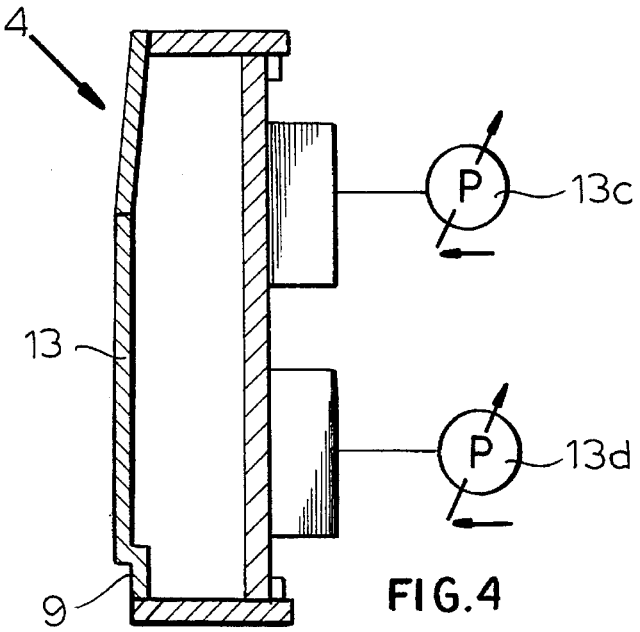
FIG. 4. is a section taken along the line IV—IV of FIG. 3.

Furthermore, and as will be apparent from the discussion of FIG. 4, the sheet metal walls 13*a* may be caused to bulge, if desired, when the pressure P is used to control the gap width in the gap of the stretching nozzle 4.

According to the invention, the filament-delivery unit 5 is provided below and separate from the stretching nozzle 4 and is constituted in the form of a jet pump with, in the vertical direction, a ventori-like intake 10, a diffuser outlet 11 and a constriction between the intake and outlet. At least one free air-intake opening 12 is provided in the region of the inlet 10*j*.

As will be apparent further from FIG. 1, the web 1 is deposited upon the sieve belt 6 which continuously moves below the delivery unit 5 which can have a pair of rollers 6*a* at the upstream side and a pair of rollers 6*b* at the downstream side of the region in which the web is deposited, to confine the spaces in this region so that suction drawn by the suction source 7 below the belt 6 can draw air in through the gap 12 and through the jet nozzle forming the delivery unit. A suction blower 7*a* of adjustable throughput is shown to be connected to the duct 7 to constitute the source.

Thus with the aid of the suction source 7, 7*a*, the air flow through the jet pump can be controlled or regulated.

Figure 3:
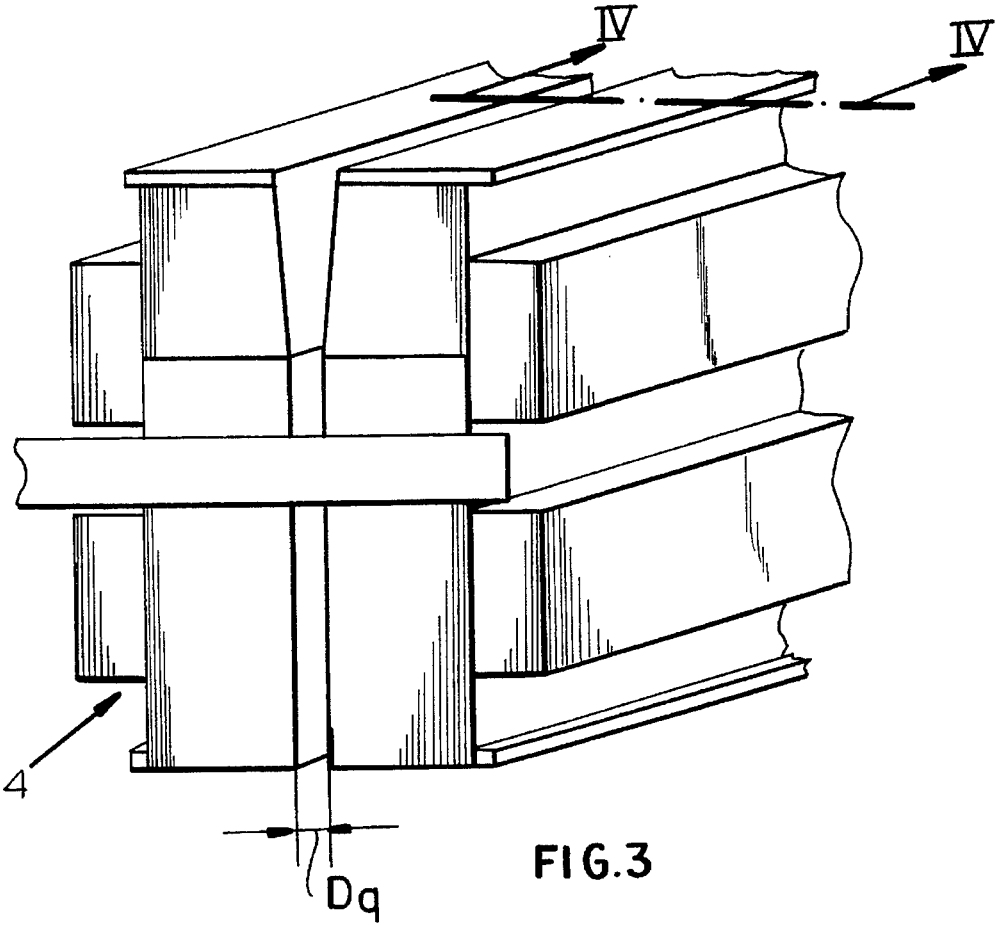
FIG. 3 is a perspective view of a portion of the stretching nozzle of the apparatus of the invention.

The double-headed arrow in FIG. 3 represents the nozzle cross section $D_q$.

From a comparison of FIGS. 3 and 4, one can see that the nozzle 4 is provided as a boxlike structure with walls 13 of sheet metal which can be deformed by the controllable pressure sources represented at 13*c* and 13*d* to control the gap or for regulating the pressure within the boxlike structures so as to prevent fluctuation of the wall 13 under the aerodynamic pressure.

The jet pump has walls 14 which define the gap thereof and can be controlled in position by servomotors 14*a* and 14*b* or the like, to thereby influence the flow cross section through the jet pump.

The smallest cross section $D_q$ should be between 0.9 $K_q$ and 0.01 $K_q$ in the best mode of carrying out the invention in practice.

We claim:

1. An apparatus for producing a spun-filament nonwoven web of thermoplastic synthetic resin, comprising:

a filament spinning head provided with a multiplicity of spinning orifices discharging respective strands of thermoplastic synthetic resin in at least one row to form a descending curtain of said strands;

a vertically extending cooling chamber below said filament spinning head receiving said curtain for quenching same and having a rectangular cross section in horizontal planes decreasing downwardly to a smallest cross section $K_q$ at a lower end of said cooling chamber;

a stretching nozzle adjacent said lower end of said cooling chamber and extending downwardly therefrom, said stretching nozzle having opposite walls defining a gap width flanking said curtain and between which said strands are aerodynamically stretched by entrainment with air through said stretching nozzle, said stretching nozzle having a rectangular flow cross section $D_q$ in a horizontal plane which is smaller by a factor of 0.9 to 0.01 than said smallest cross section $K_q$ at said lower end of said cooling chamber so that $D_q$ is substantially equal to 0.9 $K_q$ to 0.01 $K_q$;

a setback formed on a lower end of at least one of said walls;

a filament delivery unit below said stretching nozzle and receiving said strands therefrom, said filament delivery unit including a vertically disposed jet pump having an inlet at an upper end, a venturi constriction below said inlet and a diffusor outlet below and connected with said venturi constriction, said vertically disposed jet pump having a flow passage section between said inlet and said outlet which is rectangular in horizontal cross section, said inlet being open to ambient atmosphere whereby ambient air is drawn through said filament delivery unit;

a continuously movable sieve belt below said filament delivery unit receiving said strands therefrom in a nonwoven web, said nonwoven web being carried away from said filament delivery unit on said sieve belt;

a controllable flow rate suction source below said sieve belt and said filament delivery unit and communicating with said filament delivery unit through said sieve belt for regulating air flow through said vertically disposed jet pump; and means for varying the gap width of said stretching nozzle comprising a boxlike structure behind each wall and means in said boxlike structure for varying an internal pressure therein to compensate for aerostatic tendencies for deformation of said walls resulting from flow of air through said stretching nozzle.

2. The apparatus defined in claim 1 wherein said filament delivery unit has shiftable walls additionally controlling airflow therethrough by position of the shiftable walls.

* * * * *